US009353460B2

(12) United States Patent
Qi et al.

(10) Patent No.: US 9,353,460 B2
(45) Date of Patent: May 31, 2016

(54) METHOD FOR FORMING METAL STRUCTURES

(71) Applicant: XEROX CORPORATION, Norwalk, CT (US)

(72) Inventors: Yu Qi, Penfield, NY (US); Ping Liu, Mississauga (CA); Sandra J. Gardner, Oakville (CA); Yiliang Wu, Oakville (CA)

(73) Assignee: XEROX CORPORATION, Norwalk, CT (US)

( * ) Notice: Subject to any disclaimer, the term of this patent is extended or adjusted under 35 U.S.C. 154(b) by 171 days.

(21) Appl. No.: 14/034,785

(22) Filed: Sep. 24, 2013

(65) Prior Publication Data

US 2015/0086805 A1 Mar. 26, 2015

(51) Int. Cl.

| | |
|---|---|
| ***D01D 10/02*** | (2006.01) |
| ***D01F 8/14*** | (2006.01) |
| ***D01F 8/18*** | (2006.01) |
| ***D02G 3/12*** | (2006.01) |
| ***D01D 5/00*** | (2006.01) |
| ***B22F 1/00*** | (2006.01) |
| ***B22F 3/00*** | (2006.01) |
| ***D01D 5/34*** | (2006.01) |

(52) U.S. Cl.

CPC ..... *D01D 5/0007* (2013.01); *B22F 1/004* (2013.01); *B22F 1/0022* (2013.01); *B22F 3/002* (2013.01); *D01D 5/003* (2013.01); *D01D 5/0023* (2013.01); *D01D 5/0038* (2013.01); *D01D 5/34* (2013.01); *B22F 2998/10* (2013.01); *D10B 2101/20* (2013.01); *D10B 2321/022* (2013.01); *Y10T 428/12424* (2015.01)

(58) Field of Classification Search

CPC ... D01D 5/003; D01D 5/0038; D01D 5/0046; D01D 5/34; D01D 10/02; D01F 8/14; D01F 8/18; D02G 3/02; D02G 3/12; D01B 2101/20

USPC ..... 264/10, 172.15, 464, 465, 466, 484; 75/330, 345, 370, 392

See application file for complete search history.

(56) References Cited

U.S. PATENT DOCUMENTS

| | | | | |
|---|---|---|---|---|
| 2005/0111805 | A1* | 5/2005 | Hertz et al. | 385/125 |
| 2007/0113530 | A1* | 5/2007 | Morozov et al. | 55/527 |
| 2010/0113857 | A1* | 5/2010 | Ramakrishna et al. | 588/299 |
| 2010/0203333 | A1* | 8/2010 | Mokhtari et al. | 428/402 |
| 2011/0151255 | A1* | 6/2011 | Kim et al. | 264/465 X |
| 2012/0208421 | A1 | 8/2012 | Qi et al. | |
| 2012/0282484 | A1* | 11/2012 | Joo et al. | 264/10 X |
| 2014/0027954 | A1* | 1/2014 | Claracq et al. | 264/433 |

OTHER PUBLICATIONS

Hui Wu et al., "Electrospun Metal Nanofiber Webs as High-Performance Transparent Electrode", Nano Lett. 2010, 10, pp. 4242-4248.

Michael Bognitzki et al., "Preparation of Sub-micrometer Copper Fibers via Electrospinning", Adv. Mater. 2006, 18, pp. 2384-2386.

* cited by examiner

*Primary Examiner* — Leo B Tentoni

(74) *Attorney, Agent, or Firm* — MH2 Technology Law Group, LLP

(57) ABSTRACT

A method of forming a metal structure. The method comprises providing a dispersion of metal nanoparticles and a solution comprising a transient polymer and solvent. The dispersion of metal nanoparticles and the solution are formed by coaxially electrospinning into a fiber comprising the metal nanoparticles and the transient polymer. The fiber is heated to decompose the transient polymer and form a metallic structure.

18 Claims, 5 Drawing Sheets

METHOD FOR FORMING METAL STRUCTURES

DETAILED DESCRIPTION

1. Field of the Disclosure

The present disclosure is directed to a method for forming metal structures, and in particular, a method for forming metal structures by co-axial electrospinning.

2. Background

Micron and submicron metallic fibers have great potential for many applications. Examples of such applications include electronic devices, sensors, thermal management, biomedical fields, such as wound dressing materials, body wall repairs, tissue scaffolds and antimicrobial filters. Other applications include employing metal fibers in xerographic components to improve the electrical and thermal conductivity without adversely affecting performance. For fuser applications, providing adequate thermal conductivity can allow increased fusing speeds, improved fusing latitude and enable low fusing temperatures.

Metallic fibers reported in the literature have been prepared by electrospinning a metal oxide or salt with a polymer binder, such as PVB or PVA, followed by removing the polymer binder with high temperature treatment. The methodology involves a high temperature reduction process using hydrogen (e.g., 300° C.), which is not practical for some applications. (Ref. a) Adv. Mater. 2006, 18, 2384-2386. b) Nano Lett. 2010, 10, 4242-4248).

Alternative methods for making metal fibers and/or metal dots at relatively low temperatures would be a welcome step forward in the art.

SUMMARY

An embodiment of the present disclosure is directed to a method of forming a metal structure. The method comprises providing a dispersion of metal nanoparticles. A solution comprising a transient polymer and solvent is also provided. The dispersion of metal nanoparticles and the solution are coaxially electrospun to form a fiber comprising the metal nanoparticles and the transient polymer. The fiber is heated to decompose the transient polymer and form a metallic structure.

Another embodiment of the present disclosure is directed to a method of forming a metal nanostructure. The method comprises providing a dispersion of metal nanoparticles and a solution comprising a transient polymer. The dispersion of metal nanoparticles and the solution are coaxially electrospun to form a plurality of core-shell fibers. The dispersion of metal nanoparticles forms a fiber core and the transient polymer forms a polymer shell surrounding the fiber core. The core-shell fiber is heated to form a metallic nanostructure. The heating of the core-shell fiber comprises heating to a first temperature to melt the metal nanoparticles, and then heating the core-shell nanofibers to a second temperature to remove the polymer, the second temperature being higher than the first temperature. The metal nanostructure has at least one dimension that is less than 500 nm.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrate embodiments of the present teachings and together with the description, serve to explain the principles of the present teachings.

Figure 1:
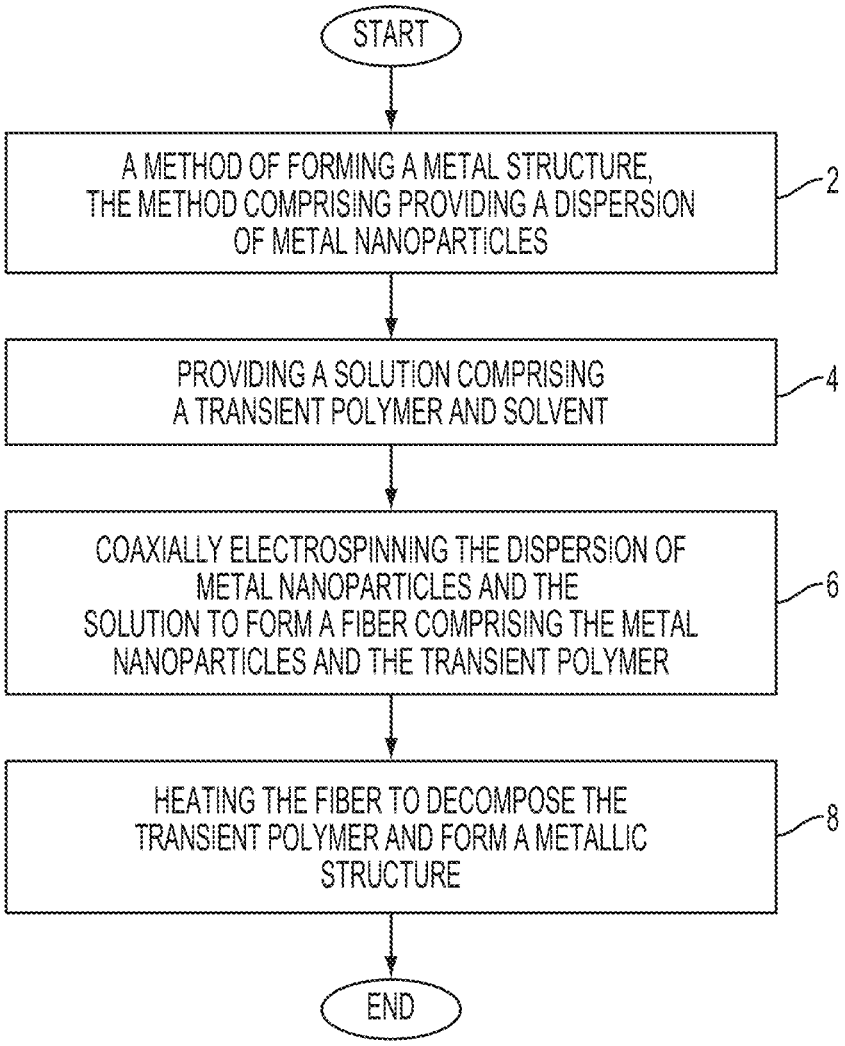
FIG. 1 shows a flow diagram of a method for forming a metal structure, according to an embodiment of the present disclosure.

It should be noted that some details of the figure have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. In the drawings, like reference numerals have been used throughout to designate identical elements. In the following description, reference is made to the accompanying drawings, which form a part thereof, and in which is shown by way of illustration a specific exemplary embodiment in which the present teachings may be practiced. The following description is, therefore, merely exemplary.

The present application is directed to a method of forming a metal structure by a co-axial electrospinning process. An embodiment of the process is illustrated by the flow diagram of FIG. 1. The method includes providing both a dispersion of metal nanoparticles and a solution comprising a transient polymer. As discussed in more detail below, both the dispersion of metal nanoparticles and the transient polymer can be spun into a fiber using a co-axial electrospinning apparatus. The fiber can then be heated to form the metal nanofibers of the present disclosure.

The metal nanoparticle dispersions employed in the processes of the present disclosure can comprise any suitable metal nanoparticles. Examples include nanoparticles comprising at least one metal selected from the group consisting of silver, gold, copper, nickel, iron, palladium, silver-copper alloy, gold-copper alloy, nickel-copper alloy, and silver-gold alloy. In an embodiment, the nanoparticles comprise silver, such as a silver-copper alloy, silver-gold alloy or substantially pure organoamine stabilized silver nanoparticles.

In an embodiment, a stabilizer is employed in the dispersion of metal nanoparticles. The stabilizer comprises an organoamine. The stabilizer can be an organoamine stabilizer such as those described in U.S. Pat. No. 7,270,694, which is incorporated by reference herein in its entirety. In an embodiment, the organoamine can comprise a hydrocarbylamine having at least 4 carbon atoms. In an embodiment, the organoamine can be selected from the group consisting of butylamine, pentylamine, hexylamine, heptylamine, octylamine, nonylamine, decylamine, hexadecylamine, undecylamine, dodecylamine, tridecylamine, tetradecylamine, diaminopentane, diaminohexane, diaminoheptane, diaminooctane, diaminononane, diaminodecane, dipropylamine, dibutylamine, dipentylamine, dihexylamine, diheptylamine, dioctylamine, dinonylamine, didecylamine, methylpropylamine, ethylpropylamine, propylbutylamine, ethylbutylamine, ethylpentylamine, propylpentylamine, butylpentylamine, tributylamine, trihexylamine and mixtures of two or more thereof. In an embodiment, the stabilizer can be dodecylamine.

The metal nanoparticles can be dispersed in an organic based solution. In embodiments, an organic solvent can be an organic hydrocarbon solvent containing from about 6 to about 28 carbon atoms, which may be substituted or unsubstituted, and can be an aliphatic or aromatic hydrocarbon. Exemplary hydrocarbons may include aliphatic hydrocarbons such as heptane, undecane, dodecane, tridecane, tetradecane, isoparaffinic hydrocarbons such as isodecane, isododecane, and commercially available mixtures of isoparaffins such as ISOPAR E, ISOPAR G, ISOPAR H, ISOPAR L and ISOPAR M (all of which are manufactured by Exxon Mobil Chemical Company of Houston, Tex.), and the like; cyclic aliphatic hydrocarbons such as bicyclopropyl, bicyclopentyl, bicyclohexyl, cyclopentylcyclohexane, spiro[2,2]heptane, bicyclo[4,2,0]octanehydroindane, decahydronaphthalene (i.e., bicyclo[4.4.0]decane or decalin), and the like; aromatic hydrocarbons such as toluene, benzene, xylenes chlorobenzene, o-dichlorobenzene; and mixtures thereof. In an example, the organic fluid includes toluene.

The solution can comprise any suitable transient polymer that facilitates fiber formation and that can be removed from the electrospun co-axial fiber by thermal degradation within the desired temperature range. Examples of suitable transient binder compounds include polyalkylene carbonates, such as poly(propylene carbonate), poly(ethylene carbonate) and poly(butylene carbonate).

Figure 2:
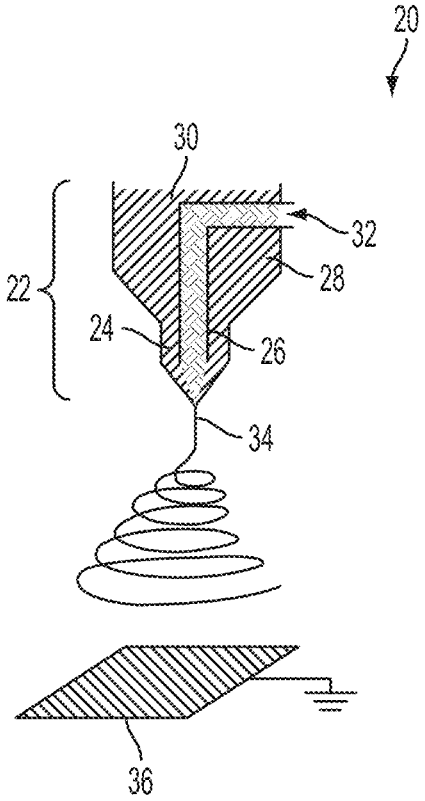
FIG. 2 illustrates an example of co-axial electrospinning apparatus that can be employed for carrying out the electrospinning process of FIG. 1, according to an embodiment of the present disclosure.

An example of co-axial electrospinning apparatus 20 that can be employed for carrying out the process of the present disclosure is illustrated in FIG. 2. Such apparatus are generally well known in the art. A spinneret 22 can include a first injector 26 concentrically positioned within in a second injector 28. Second injector 28 includes a metal tip 24. The second injector 28 can deliver a solution 30. The first injector 26 can deliver the dispersion of metal nanoparticles 32. The solution 30 and the dispersion of metal nanoparticles 32 can be delivered simultaneously from the spinneret 22 as a charged jet 34. During extrusion of the fiber, the metal tip 24 is electrified to charge the jet 34 by techniques that are well known in the art. The charged jet 34 can be collected on a collector 36.

Figure 3:
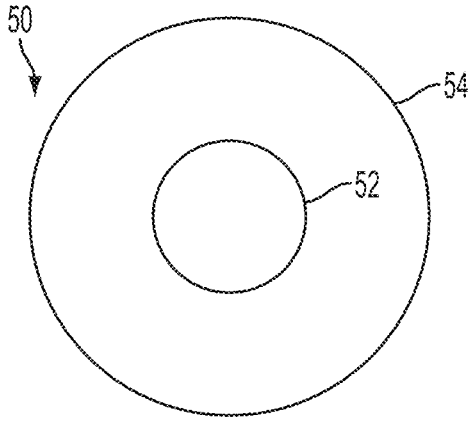
FIG. 3 illustrates a core-shell fiber, according to an embodiment of the present disclosure.
Figure 4:
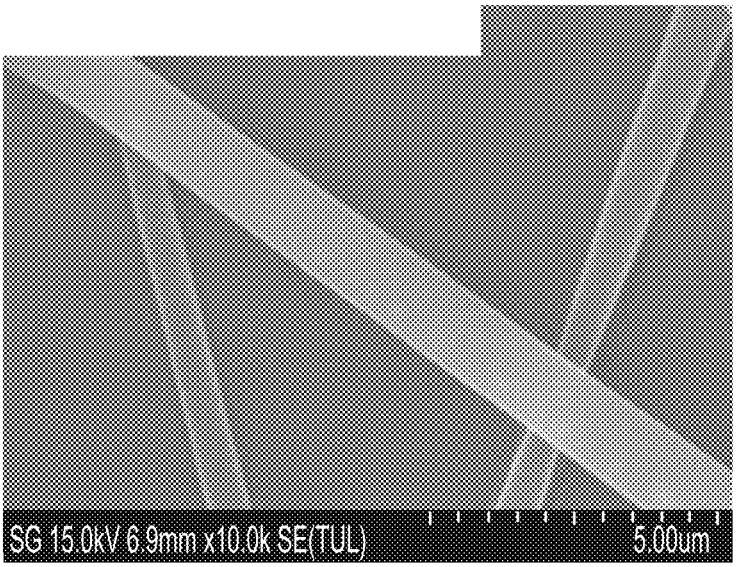
FIG. 4 illustrates an SEM image of a spun co-axial fiber prior to heating, according to an embodiment of the present disclosure.

By employing a co-axial electrospinning apparatus in this manner, the solution and the dispersion of metal nanoparticles can be spun into one or more fibers. In an embodiment, the fibers are core-shell fibers. FIG. 3 illustrates a cross sectional view of a core-shell fiber 50, according to an embodiment of the present disclosure. Core-shell fiber 50 includes a core region 52 comprising the metal nanoparticle dispersion. A shell region 54 surrounds core region 52 and comprises the transient polymer. While the core region 52 and shell region 54 are shown as having perfect separation, in reality there may be some mixing of the materials from the two regions during the jetting process. FIG. 4 illustrates an SEM image of a spun co-axial fiber prior to heating, according to an embodiment of the present disclosure.

Referring back to text block 8 of the flow diagram of FIG. 1, the fiber can then be heated to decompose and remove the transient polymer. Any suitable heating process that can remove the transient polymer may be employed. In an embodiment, the heating process includes heating of the fiber to a first temperature to melt the metal nanoparticles. Following the first heating step, the fiber is heated to a second temperature that is higher than the first temperature to remove the transient polymer.

In an embodiment, temperatures used during the heating of the fiber are less than 350° C. For example, in a two step process, a temperature of the first heating step may be chosen from temperatures ranging from about 100° C. to about 180° C.; and the temperature of the second heating step may be chosen from temperatures ranging from about 200° C. to about 300° C. The temperatures employed will vary depending on the specific materials used for the fiber, and may be outside these ranges.

It was surprisingly found that during heating, the metal accumulated at both edges of the core-shell fiber 50, leaving the central portion of the fiber with little or no metal. In an embodiment, the migration of the metal to the edges of the core-shell and the removal of the polymer by thermal degradation resulted in the one as-spun fiber becoming two relatively narrow metal nanostructures.

In an embodiment, the metal fibers have a diameter ranging from about 40 nm to about 5 microns, such as about 100 nm to about 2 microns, or about 500 nm to about 1 microns. Depending on the parameters of the process, the metal nanostructures can be metal lines having a width less than 500 nm. For example, the width can range from about 40 nm to about 500 nm, such as about 100 nm to about 300 nm. In yet another embodiment, two linear arrays of metal dots can be formed instead of the metal lines. The dots can have diameters of, for example, 500 nm or less. By optimizing the electrospinning process parameters, such as flow-rate, applied voltage, distance between spinneret and collector, and the concentration of the polymer solution, metal fibers or dots with desired size and morphology can be obtained.

Figure 5:
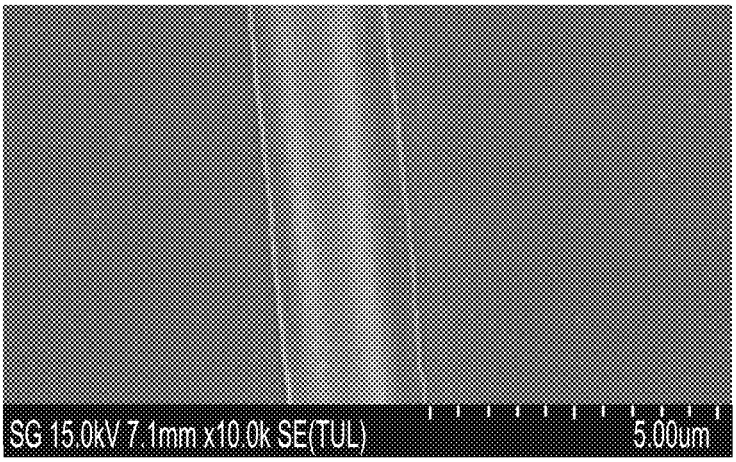
FIG. 5 illustrates an SEM image of a fiber after an initial heating step of the fiber of FIG. 4 at 130° C., according to an embodiment of the present disclosure.
Figure 6:
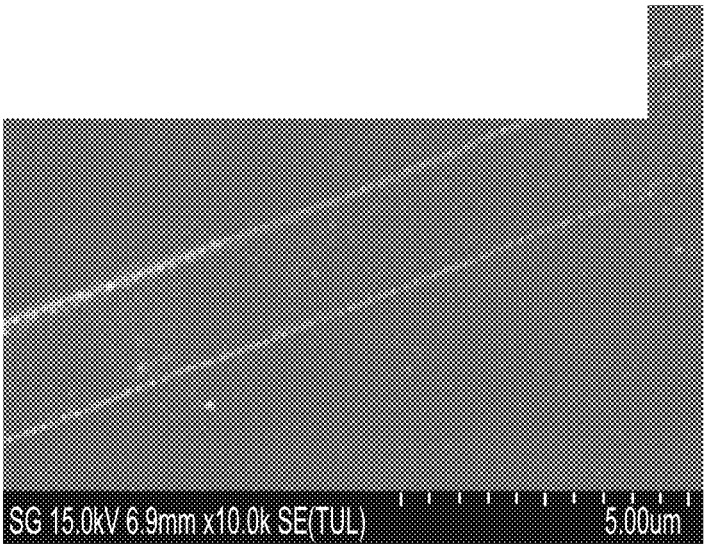
FIG. 6 illustrates an SEM image showing the formation of a silver fiber after removal of transient polymer from the fiber of FIG. 5, according to an embodiment of the present disclosure.

FIG. 5 illustrates an SEM image of a fiber after an initial heating step at 130° C. FIG. 6 illustrates an SEM image showing the formation of a silver fiber after removal of the transient polymer.

The present disclosure is also directed to a conductive layer comprising a network of a plurality of metal fibers formed by the processes of the present disclosure. The conductive layer can be formed using any suitable technique for forming a layer from metal fibers.

EXAMPLES

A 5% poly(propylene carbonate) in MEK solution was poured into a 10 mL syringe of a co-axial electrospinning apparatus. A 40 wt % Ag nanoparticle dispersion in toluene was poured into a 3 mL syringe of the apparatus. The two syringes were mounted into their respective syringe pumps (PPC on the shell channel and Ag on the core channel), and the syringes were connected to the coaxial spinneret. A glass slide (electrospinning collector) was wiped clean using isopropanol, and placed upright approximately 15 cm away from the spinneret tip. About 18-20 kv was applied at the spinneret. Fibers with about 1 μm diameter were generated and collected on the glass slide. An SEM image of the fiber is shown in FIG. 4.

The as-spun fiber samples were heated at 130° C. for 15 minutes. Formation of silver fibers was confirmed by optical microscopy, and an SEM image of the fiber is shown at FIG. 5. The sample was then baked at 260° C. to remove the transient PPC polymer. An SEM image of the fiber after the high temperature heat step is shown at FIG. 6.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompasses by the following claims.

What is claimed is:

1. A method of forming a metal structure, the method comprising:

providing a dispersion of metal nanoparticles, the dispersion of metal nanoparticles comprising an organic solvent selected from the group consisting of unsubstituted aliphatic hydrocarbons containing 6 to 28 carbon atoms, heptane, undecane, dodecane, tridecane, tetradecane, isoparaffinic hydrocarbons, bicyclopropyl, bicyclopentyl, bicyclohexyl, cyclopentylcyclohexane, spiro[2,2]heptane, bicyclor[4,2,0]octanehydroindane, decahydronaphthalene and aromatic hydrocarbons;

providing a solution comprising a transient polymer and solvent, the transient polymer comprising a polyalkylene carbonate;

coaxially electrospinning the dispersion of metal nanoparticles and the solution to form a core-shell fiber comprising the metal nanoparticles and the transient polymer, wherein the dispersion of metal nanoparticles forms a fiber core and the transient polymer forms a polymer shell surrounding the fiber core, and heating the core-shell fiber to decompose the transient polymer, wherein during the heating the metal nanoparticles migrate to and accumulate at edges of the fiber to form two metallic nanostructures from a single one of the core-shell fiber, wherein each of the two metallic nanostructures is either a metal line or a linear array of metal dots.

2. The method of claim 1, wherein the metal nanoparticles comprise at least one metal selected from the group consisting of silver, gold, copper, nickel, iron and palladium.

3. The method of claim 2, wherein the at least one metal is an alloy selected from the group consisting of silver-copper, gold-copper, nickel-copper and silver-gold.

4. The method of claim 1, wherein the dispersion of metal nanoparticles comprise organoamine-stabilized silver nanoparticles in an organic solvent.

5. The method of claim 1, wherein the heating of the core-shell fiber comprises heating at a temperature less than 350° C.

6. The method of claim 1, wherein the heating of the core-shell fiber comprises heating to a first temperature to melt the metal nanoparticles; and then heating the core-shell fiber to a second temperature to remove the polymer, the second temperature being higher than the first temperature.

7. The method of claim 6, wherein the first temperature is chosen from temperatures ranging from about 100° C. to about 180° C.; and the second temperature is chosen from temperatures ranging from about 200° C. to about 300° C.

8. The method of claim 1, wherein the metallic nanostructures are metal lines.

9. The method of claim 1, wherein the metallic nanostructures are linear arrays of metal dots.

10. The method of claim 8, wherein the metal line has a width of less than 500 nm.

11. A method of forming a metal structure, the method comprising:

providing a dispersion of metal nanoparticles;

providing a solution comprising a transient polymer and solvent;

coaxially electrospinning the dispersion of metal nanoparticles and the solution to form a fiber comprising the metal nanoparticles and the transient polymer, and heating the fiber to decompose the transient polymer and form a metallic structure, wherein the metallic structure comprises metal fibers, two metal nanofibers being formed from each fiber.

12. The method of claim 11, wherein the fiber is a core-shell fiber, the dispersion of metal nanoparticles forming the fiber core and the transient polymer forming the fiber shell.

13. The method of claim 12, wherein the transient binder comprises a polyalkylene carbonate.

14. A method of forming a metal nanostructure, the method comprising:

providing a dispersion of metal nanoparticles, the dispersion of metal nanoparticles comprising an organic solvent selected from the group consisting of unsubstituted aliphatic hydrocarbons containing 6 to 28 carbon atoms, heptane, undecane, dodecane, tridecane, tetradecane, isoparaffinic hydrocarbons, bicyclopropyl, bicyclopentyl, bicyclohexyl, cyclopentylcyclohexane, spiro[2,2]heptane, bicyclof[4,2,0]octanehydroindane, decahydronaphthalene and aromatic hydrocarbons;

providing a solution comprising a transient polymer, the transient polymer comprising a polyalkylene carbonate; and coaxially electrospinning the dispersion of metal nanoparticles and the solution to form a core-shell fiber, wherein the dispersion of metal nanoparticles forms a fiber core and the transient polymer forms a polymer shell surrounding the fiber core;

heating the core-shell fiber to form a metallic nanostructure, wherein the heating of the core-shell fiber comprises heating to a first temperature to melt the metal nanoparticles, and then heating the core-shell fiber to a second temperature to remove the polymer, the second temperature being higher than the first temperature, wherein during the heating the metal nanoparticles migrate to and accumulate at edges of the core-shell fiber to form two metallic nanostructures from a single one of the core-shell fiber, wherein each of the two metallic nanostructures is either a metal line or a linear array of metal dots; and wherein the metallic nanostructures have at least one dimension that is less than 500 nm.

15. The method of claim 14, wherein the metal nanoparticles comprise silver and are stabilized with organic amines.

16. The method of claim 14, wherein the first temperature is chosen from temperatures ranging from about 100° C. to about 180° C.; and the second temperature is chosen from temperatures ranging from about 200° C. to about 300° C.

17. The method of claim 14, wherein the metallic nanostructures are metal lines.

18. The method of claim 14, wherein the metallic nanostructures are linear arrays of metal dots.

* * * * *